US005973217A

United States Patent [19]

Hastrich et al.

[11] Patent Number: 5,973,217

[45] Date of Patent: Oct. 26, 1999

[54] METHOD FOR PROCESSING RECYCLED OR SCRAP PLASTICS

[75] Inventors: Horst Hastrich, Essen; Christian Hecka, Gladbeck; Rolf Holighaus, Haltern; Klaus Niemann, Oberhausen; Claus Strecker, Gelsenkirchen, all of Germany

[73] Assignee: Veba Oel AG, Gelsenkirchen, Germany

[21] Appl. No.: 08/945,555

[22] PCT Filed: May 2, 1996

[86] PCT No.: PCT/EP96/01812

§ 371 Date: Jan. 9, 1998

§ 102(e) Date: Jan. 9, 1998

[87] PCT Pub. No.: WO96/34929

PCT Pub. Date: Nov. 7, 1996

[30] Foreign Application Priority Data

May 4, 1995 [DE] Germany ..... 195 16 379

[51] Int. Cl.[6] ..... C10G 1/10; C07C 1/00

[52] U.S. Cl. ..... 585/241; 585/832; 201/2.5; 201/25

[58] Field of Search ..... 585/241, 240, 585/832; 208/400, 415, 418, 435; 201/2.5, 25

[56] References Cited

U.S. PATENT DOCUMENTS

| | | | |
|---|---|---|---|
| 4,982,027 | 1/1991 | Korff et al. | 585/241 |
| 5,061,363 | 10/1991 | Farcasiu et al. | 208/419 |
| 5,639,937 | 6/1997 | Hover et al. | 585/241 |
| 5,731,483 | 3/1998 | Stabel et al. | 585/241 |

FOREIGN PATENT DOCUMENTS

| | | | |
|---|---|---|---|
| WO 94/22979 | 10/1994 | WIPO | C10G 1/10 |

*Primary Examiner*—Bekir L. Yildirim
*Attorney, Agent, or Firm*—Oblon, Spivak, McClelland, Maier & Neustadt, P.C.

[57] ABSTRACT

According to the process described, old or waste plastics are depolymerized into a pumpable phase and a volatile phase to allow recovery of chemical raw materials and liquid fuel components. The volatile phase is separated into a gaseous phase and a condensate. In order to simplify the process in comparison with the state of the art, the depolymerised product remaining after the volatile phase is separated is also heated together with the condensate or condensate fractions in the presence of hydrogen under pressure and is subjected to hydrotreating, after non-boiling components are removed, to produce syncrude.

20 Claims, 3 Drawing Sheets

METHOD FOR PROCESSING RECYCLED OR SCRAP PLASTICS

BACKGROUND OF THE INVENTION

1. Field of the Invention

The invention relates to a method for processing recycled or scrap plastics for the purpose of obtaining raw chemical materials and liquid fuel components, by means of depolymerization of the substances being used, at elevated temperature, to produce both a pumpable and a volatile phase, and separation of the volatile phase into a gas phase and a condensate.

2. Description of the Background

In the depolymerization of recycled or scrap plastics, not only melt-viscous depolymerizate, but also a gas phase and a condensate are obtained, and the condensate must be additionally treated with hydrogenation, because of its chlorine content and low stability. With regard to the state of the art, we refer to the PCT application WO 94/22979.

From the aforementioned document, it is evident that the condensable depolymerization products can be subjected to hydrogenating refining on a solid bed catalyst, or also on a moving catalyst, or a bubbling catalyst bed. Such hydrogenating refining represents normal refining processes, which are also referred to as hydrotreating in the technical literature.

The condensates to be subjected to hydrotreating, however, contain non-evaporating components which come from the depolymerizer, because of foaming, spraying, or vapor inclusions, and also those that have been reformed by means of repolymerization, so that direct charging of a catalyst layer arranged in fixed manner in a hydrotreater would result in rapid inactivation of the same, i.e. would result in very high catalyst consumption. In addition, because of the instability of such condensates, coatings would form on heat exchangers, for example pre-heaters, which would prevent sufficiently long times of operation without interruptions. Document WO 94/22979 teaches converting the condensate, for example by hydrotreating it on commercially available Co—Mo or Ni—Mo catalysts arranged in fixed manner, or introducing it directly into chemical, technical or usual refining processes which tolerate chlorine, as a base substance which contains hydrocarbons (syncrude) (see p. 5), where a prior "guard bed" to extend the useful lifetime of the catalyst layer arranged in fixed manner is also taken into consideration (see page 9, line 7, op. cit.).

From the aforementioned state of the art, the technical teaching of a combination of depolymerization, hydrogenating treatment, preferably of distillate components that have been produced, with sump phase hydrogenation, gasification and/or low temperature carbonization can be derived. Here the task of simplifying the process comes up.

A further task is to prevent rapid inactivation of the catalyst charge of the hydrotreating stage.

SUMMARY OF THE INVENTION

Accordingly, with the method indicated at the beginning, the invention consists of the fact that the depolymerizate which remains after separation of the volatile phase is heated, together with the condensate or portions of the condensate, in the presence of hydrogen, under pressure, and after separation of non-volatile components, is subjected to hydrotreating to obtain a syncrude.

DETAILED DESCRIPTION OF THE INVENTION

Figure 1:
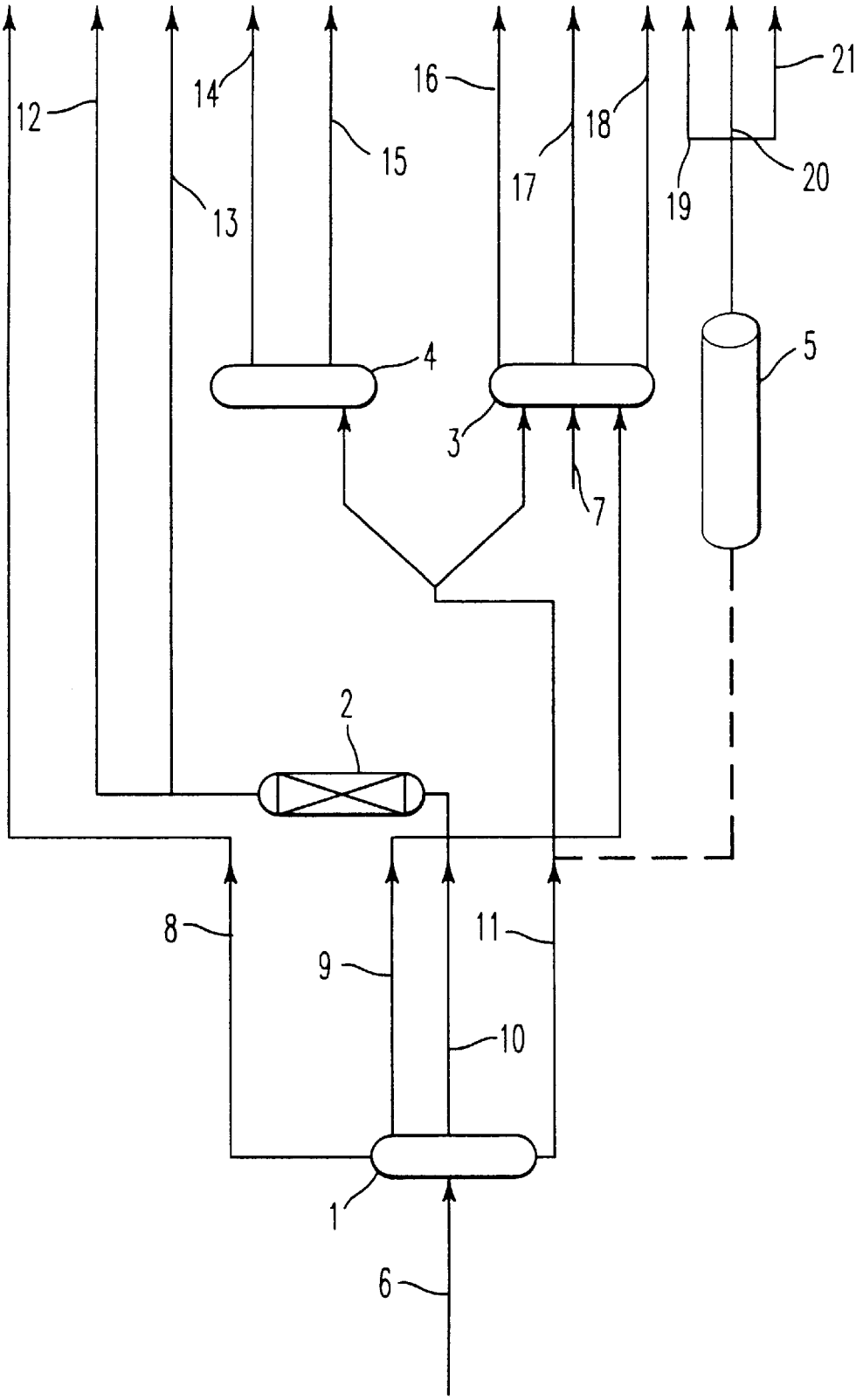

In this connection, the condensate or the non-volatile fraction of the condensate is heated to above the response temperature of the hydrotreating catalyst, together with the depolymerizate and hydrogen, under pressure.

Here, the process can be carried out in such a way that a sufficient dwell time at an elevated temperature is available in the heating segment, so that further splitting and viscosity reduction of the depolymerizate is achieved.

The process can also be structured in such a way that a dwell-time vessel follows the heating segment. In this way, depolymerization is driven so far that losses due to outward transfer of residues can be kept low.

It is practical if hydrotreating is conducted at the temperature pre-determined by the pre-heater. In this connection, the presence of hydrogen under pressure as well as dilution of the condensate with depolymerizate prevents the heat exchanger tube of the pre-heater from closing up.

The hydrotreater is protected, to a great extent, when it is preceded by a highly effective vapor/liquid separator before having the non-volatile material applied to it. In this way, service life times which meet commercial requirements are achieved. The non-volatile components are drawn off at the bottom of the vapor/liquid separator, also referred to as a hot separator, in a consistency capable of flow. They can be relaxed in several stages and the remaining distillable components, which can be combined with the condensate from polymerization, can be separated in a vacuum column, for example.

From the run-off of vacuum distillation, a partial flow of the residue can be branched off and passed to the depolymerizate, before hydrogen is applied to it. With this reflux, the process can be designed for very small amounts of residue, without the risk of running the pre-heater or a subsequent dwell-time vessel dry.

The reflux rate of vacuum distillation residue with reference to the depolymerizate amount is from 0 to 500%, depending on the quality of the material used, i.e. as a function of its tendency to depolymerize, under the stated conditions. Preferably, the reflux rate is 150 to 250%, e.g. for typical fractions of recycled or scrap plastics from household recyclables as they are obtained from the Duales System Deutschland-DSD [Dual System of Germany—recycling system in use in Germany].

Depolymerization is carried out at a pressure of 0.1 to 100 bar, particularly 0.2 to 5 bar, a temperature of 250 to 450° C., particularly 370 to 420° C., and a dwell time of 0.1 to 10 h, preferably 0.5 to 5 hours.

The hydrogen partial pressure in the hydrogenation stage is set at 50 to 200 bar, preferably 100 to 200 bar.

The temperature of the depolymerizate and the condensate when they exit from the pre-heater is set at 350 to 460, preferably 380 to 425° C.

It is practical if the process parameters are selected in such a way that the proportion of condensate with reference to the amount of recycled or scrap plastic used is 25 to 75, preferably 40 to 60% by weight.

Further preferred measures are indicated in the dependent claims 11 to 16, to which reference is hereby made.

A typical version of the process according to the invention is presented in the schematic of the attached figure. The reference symbols 1 to 11 contained in the schematic have the following significance:

1 depolymerizer
2 pre-heater
3 hot separator
4 reactor for catalytic hydrogenation
5 condensation of depolymerization vapors (1st stage)

6 condensation of depolymerization vapors (2nd stage)
7 relaxation of residue
8 vacuum distillation of residue
9 dwell-time vessel for residue minimization (optional)
10 HCl scrubber
11 cold separator The process is carried out in such a way that suitable mixtures of recycled and scrap plastic are brought into the melt-viscous state in depolymerizer 1, at an elevated temperature and the selected pressure, and depolymerized. Solid components such as aluminum or other metal residues are drawn off at the bottom of depolymerizer 1.

The volatile phase which collects in depolymerizer 1 is converted to a condensed phase in at least one condensation stage 5, 6; this condensed phase is heated while hydrogen is applied to it, and, if necessary after passing through a dwell-time segment 9, it is passed to an effective hot separator 3 to be separated into volatile products and residue components, for the purpose of minimizing residue. The products drawn off overhead from hot separator 3 are passed to a hydrotreating stage in reactor 4, for catalytic hydrogenation, and it is practical if they are separated into a syncrude as well as gaseous products in a cold separator 11, where heat exchange with the products passed to preheater 2 takes place. Some of the gaseous products can be mixed in with the fresh hydrogen which is added.

The syncrude is the target product of the present process for material recycling of recycled or scrap plastics.

The residue components drawn out of hot separator 3 are relaxed in a device 7 suitable for this purpose, and can be separated, for example, into distillate components which can be recirculated, as well as a residue that is transferred outward, in a vacuum distillation 8; some of the latter residue can also be passed back to the depolymerizate.

The non-condensed phase which is obtained in condensation stages 5 and 6 is added to the fresh hydrogen, after having passed through an HCl scrubber 10, for the purpose of removing hydrogen chloride.

We claim:

1. A method for processing recycled or scrap plastics for the purpose of obtaining raw chemical materials and liquid fuel components, consisting essentially of the steps:

depolymerizing said recycled or scrap plastics at elevated temperature, to produce a mixture comprising: (1) a pumpable depolymerizate, (2) a condensate, and (3) a gas phase;

separating the gas phase (3) from said mixture;

heating the pumpable depolymerizate (1) together with the condensate (2) in a pre-heater in the presence of hydrogen, under pressure; and hydrogenating the pumpable depolymerizate (1) together with the condensate (2) to obtain a syncrude.

2. Method according to claim 1, wherein the depolymerization is carried out at a pressure of 0.1 to 100 bar, a temperature of 250 to 450° C., hours.

3. Method according to claim 2, wherein the process parameters pressure, temperature, and dwell time are selected in such a way that the proportion of condensate with reference to the amount of recycled or scrap plastic used is 25 to 75% by weight.

4. Method according to claim 1, wherein the temperature of the depolymerizate and the condensate when they exit from the pre-heater is 350 to 460.

5. Method according to claim 4, wherein the hydrogen partial pressure at the selected temperature amounts to 50 to 200 bar.

6. Method according to claim 1, wherein the non-volatile components are drawn off at the bottom of a hot separator, in a consistency capable of flow.

7. Method according to claim 6, wherein the nonvolatile components are subjected to vacuum distillation after relaxation in several stages.

8. Method according to claim 7, wherein the distillable components from vacuum distillation are added to the condensate from depolymerization.

9. Method according to claim 7, wherein a partial flow of the residue from vacuum distillation is passed to the depolymerizate.

10. Method according to claim 9, wherein the reflux rate of vacuum distillation residue with reference to the depolymerizate amount is 0 to 500%.

11. Method according to claim 1, wherein depolymerization is conducted under turbulent flow conditions.

12. Method according to claim 1, wherein depolymerization is conducted under inert gas.

13. Method according to claim 1, wherein depolymerization is conducted using stripping media such as nitrogen, steam, gases containing hydrocarbons, or other volatile substances.

14. Method according to claim 1, wherein no liquid ancillary phase is added to the recycled or scrap plastics used.

15. Method according to claim 1, wherein scrubbing to remove acid components such as hydrogen chloride from the gaseous depolymerization products is carried out.

16. The method according to claim 1, wherein the depolymerization is carried out at a pressure of 0.2 to 2 bar, a temperature of 250 to 450° C. and a dwell time of 0.5 to 5 hours.

17. The method according to claim 2, wherein the process parameters, pressure, temperature, and dwell time are selected such that the proportion of condensate with reference to the amount of recycled or scrap plastic used is 40 to 60% by weight.

18. The method according to claim 1, wherein the temperature of the depolymerizate and the condensate when they exit from the pre-heater is 380 to 425° C.

19. The method according to claim 4, wherein the hydrogen partial pressure at the selected temperature is 100 to 200 bar.

20. The method according to claim 9, wherein the reflux rate of vacuum distillation residue with reference to the depolymerization is 150 to 250%.

* * * * *

UNITED STATES PATENT AND TRADEMARK OFFICE

CERTIFICATE OF CORRECTION

PATENT NO. : 5,973,217
DATED : October 26, 1999
INVENTOR(S) : Hastrich et al.

Figure 2:
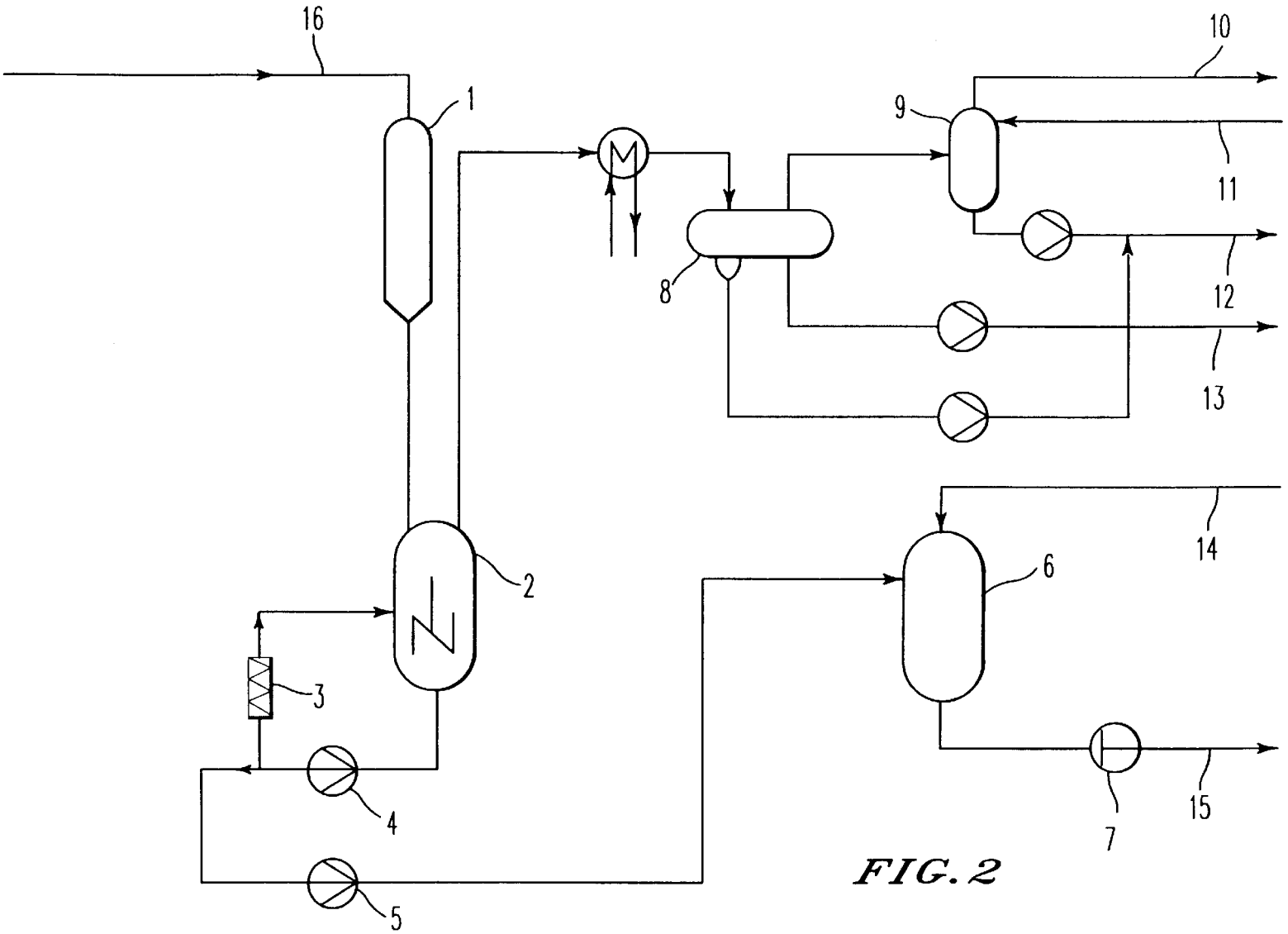
Figure 3:
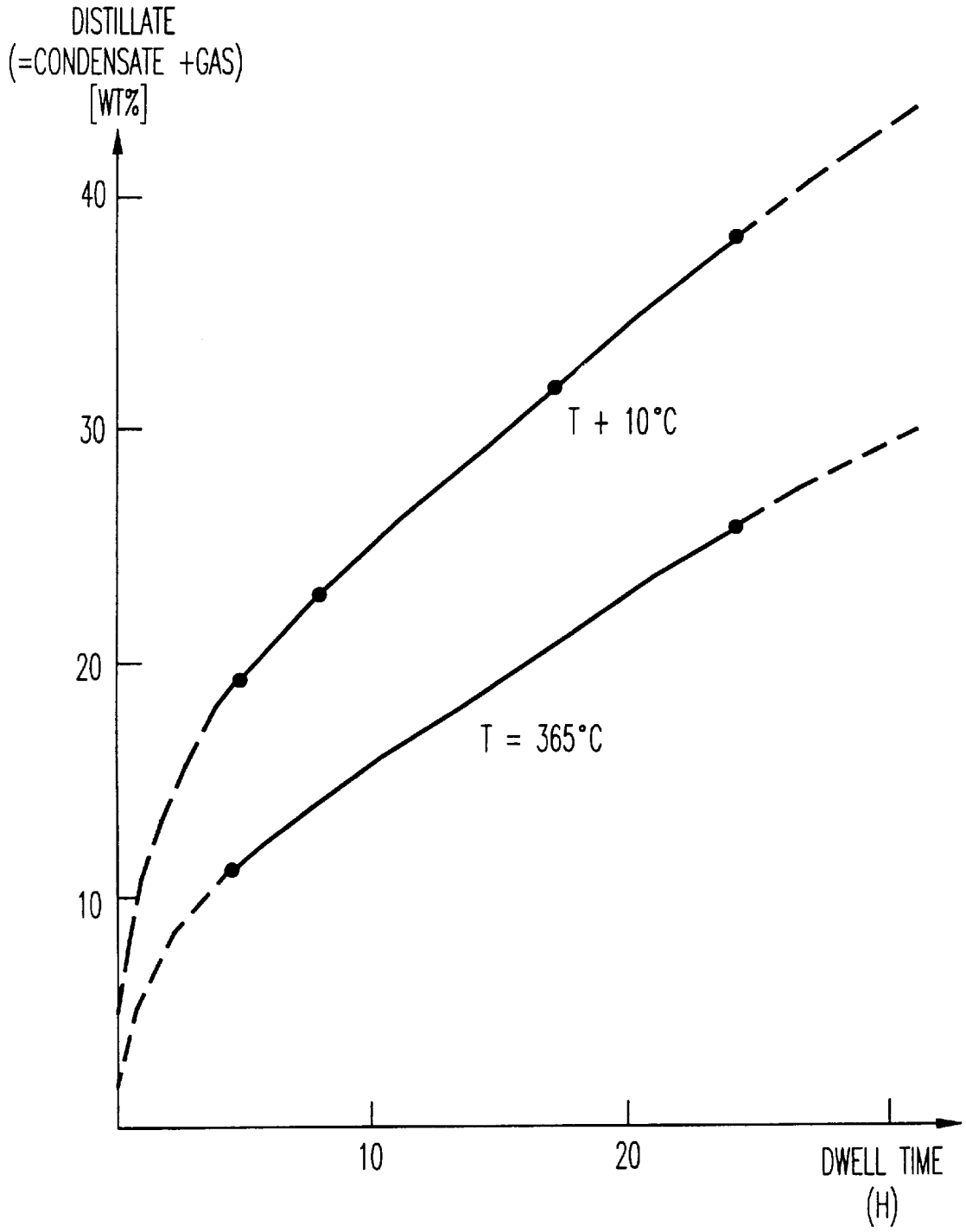
Figure 1:
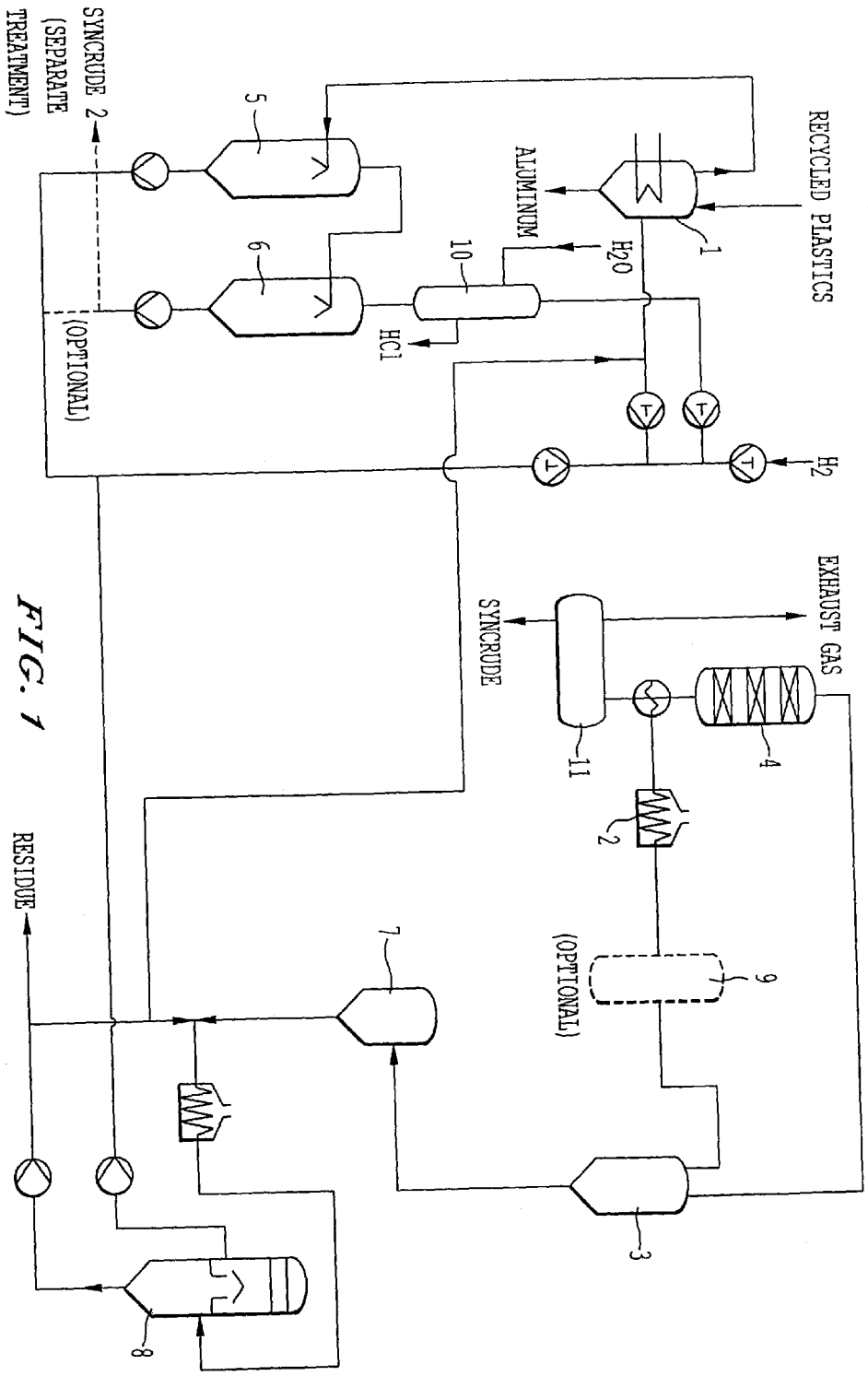

It is certified that error appears in the above-identified patent and that said Letters Patent is hereby corrected as shown below:

Please delete Figures 1, 2, 3 in its entirety and Figure 1 on the title page, and substitute therefor the attached FIG. 1 only.

Signed and Sealed this

Twenty-sixth Day of August, 2003

JAMES E. ROGAN
*Director of the United States Patent and Trademark Office*

United States Patent [19]

Hastrich et al.

[11] Patent Number: 5,973,217

[45] Date of Patent: Oct. 26, 1999

[54] METHOD FOR PROCESSING RECYCLED OR SCRAP PLASTICS

[75] Inventors: Horst Hastrich, Essen; Christian Hecka, Gladbeck; Rolf Holighaus, Haltern; Klaus Niemann, Oberhausen; Claus Strecker, Gelsenkirchen, all of Germany

[73] Assignee: Veba Oel AG, Gelsenkirchen, Germany

[21] Appl. No.: 08/945,555

[22] PCT Filed: May 2, 1996

[86] PCT No.: PCT/EP96/01812

§ 371 Date: Jan. 9, 1998

§ 102(e) Date: Jan. 9, 1998

[87] PCT Pub. No.: WO96/34929

PCT Pub. Date: Nov. 7, 1996

[30] Foreign Application Priority Data

May 4, 1995 [DE] Germany ..... 195 16 379

[51] Int. Cl.[6] ..... C10G 1/10; C07C 1/00

[52] U.S. Cl. ..... 585/241; 585/832; 201/2.5; 201/25

[58] Field of Search ..... 585/241, 240, 585/832; 208/400, 415, 418, 435; 201/2.5, 25

[56] References Cited

U.S. PATENT DOCUMENTS

| | | | |
|---|---|---|---|
| 4,982,027 | 1/1991 | Korff et al. | 585/241 |
| 5,061,363 | 10/1991 | Farcasiu et al. | 208/419 |
| 5,639,937 | 6/1997 | Hover et al. | 585/241 |
| 5,731,483 | 3/1998 | Stabel et al. | 585/241 |

FOREIGN PATENT DOCUMENTS

| | | | |
|---|---|---|---|
| WO 94/22979 | 10/1994 | WIPO | C10G 1/10 |

*Primary Examiner*—Bekir L. Yildirim
*Attorney, Agent, or Firm*—Oblon, Spivak, McClelland, Maier & Neustadt, P.C.

[57] ABSTRACT

According to the process described, old or waste plastics are depolymerized into a pumpable phase and a volatile phase to allow recovery of chemical raw materials and liquid fuel components. The volatile phase is separated into a gaseous phase and a condensate. In order to simplify the process in comparison with the state of the art, the depolymerised product remaining after the volatile phase is separated is also heated together with the condensate or condensate fractions in the presence of hydrogen under pressure and is subjected to hydrotreating, after non-boiling components are removed, to produce syncrude.

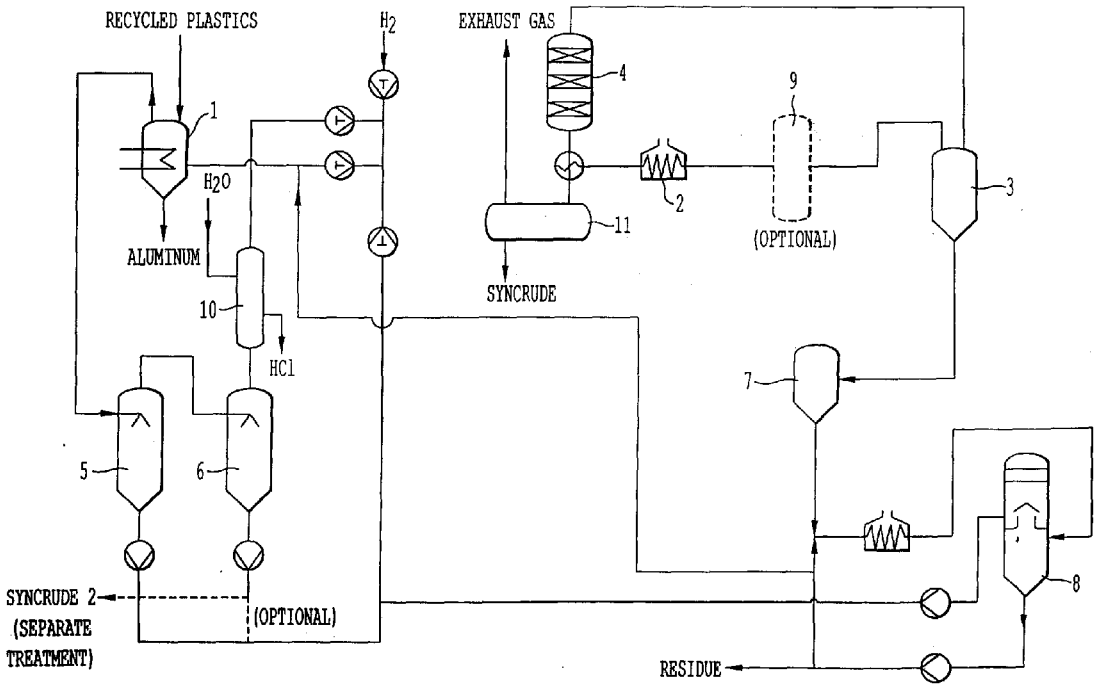

20 Claims, 3 Drawing Sheets